US011242223B2

(12) United States Patent
Kalliomäki

(10) Patent No.: US 11,242,223 B2
(45) Date of Patent: Feb. 8, 2022

(54) CONSTANT DECELERATION PROGRESSIVE SAFETY GEAR SYSTEM

(71) Applicant: KONE Corporation, Helsinki (FI)

(72) Inventor: Jaakko Kalliomäki, Hyvinkää (FI)

(73) Assignee: KONE CORPORATION, Helsinki (FI)

( * ) Notice: Subject to any disclaimer, the term of this patent is extended or adjusted under 35 U.S.C. 154(b) by 329 days.

(21) Appl. No.: 16/457,526

(22) Filed: Jun. 28, 2019

(65) Prior Publication Data

US 2020/0079621 A1 Mar. 12, 2020

(30) Foreign Application Priority Data

Sep. 7, 2018 (EP) ..... 18193129

(51) Int. Cl.

| | |
|---|---|
| ***B66B 5/22*** | (2006.01) |
| ***B66B 7/06*** | (2006.01) |
| ***B66B 11/02*** | (2006.01) |
| ***B66B 17/12*** | (2006.01) |
| ***B66B 5/04*** | (2006.01) |

(52) U.S. Cl.

CPC ..... *B66B 5/22* (2013.01); *B66B 7/068* (2013.01); *B66B 11/02* (2013.01); *B66B 17/12* (2013.01); *B66B 5/04* (2013.01)

(58) Field of Classification Search

CPC ..... B66B 5/22; B66B 7/068; B66B 11/02; B66B 17/12; B66B 5/04; B66B 11/0095

See application file for complete search history.

(56) References Cited

U.S. PATENT DOCUMENTS

| | | | | |
|---|---|---|---|---|
| 4,236,605 | A * | 12/1980 | Lindbergh | B66B 17/12 187/405 |
| 9,227,815 | B2 * | 1/2016 | Martinelli | B66B 1/32 |
| 9,586,792 | B2 * | 3/2017 | Shiraishi | B66B 5/22 |
| 9,643,815 | B2 * | 5/2017 | Wei | B66B 5/00 |
| 10,501,286 | B2 * | 12/2019 | Schmidt | B66B 1/3461 |
| 10,584,014 | B2 * | 3/2020 | Fauconnet | B66B 5/044 |
| 2003/0085078 | A1 * | 5/2003 | Simmonds | B66B 5/22 187/373 |
| 2008/0067014 | A1 * | 3/2008 | Kocher | B66B 5/0031 187/393 |

(Continued)

FOREIGN PATENT DOCUMENTS

WO WO 2012/159824 A1 11/2012

OTHER PUBLICATIONS

Extended European Search Report is issued in Patent Application No. 18193129.6 dated Mar. 20, 2019.

*Primary Examiner* — Michael R Mansen
*Assistant Examiner* — Michelle M Lantrip
(74) *Attorney, Agent, or Firm* — Birch, Stewart, Kolasch & Birch, LLP

(57) ABSTRACT

A safety gear system for an elevator has a main static mass, an auxiliary static mass and a dynamically changing mass, wherein the dynamically changing mass changes in accordance with the travel of the main static mass. The safety gear system includes at least one first safety gear which is configured to brake the auxiliary static mass by a constant braking force, and at least one second safety gear which is configured to brake the main static mass and the dynamically changing mass by an adjustable brake force which is adjustable in accordance with the change of the dynamically changing mass.

18 Claims, 3 Drawing Sheets

(56) References Cited

U.S. PATENT DOCUMENTS

| | | | | |
|---|---|---|---|---|
| 2010/0187047 | A1* | 7/2010 | Gremaud | B66B 5/027 187/351 |
| 2011/0120809 | A1* | 5/2011 | Kocher | B66B 5/16 187/249 |
| 2012/0152659 | A1 | 6/2012 | Husmann et al. | |
| 2012/0152663 | A1* | 6/2012 | Legeret | B66B 5/04 187/404 |
| 2013/0248296 | A1 | 9/2013 | Husmann | |
| 2014/0332324 | A1* | 11/2014 | Husmann | B66B 5/20 187/359 |
| 2015/0321883 | A1* | 11/2015 | Husmann | B66B 5/20 187/374 |
| 2017/0008732 | A1* | 1/2017 | Shiraishi | B66B 5/04 |
| 2018/0186596 | A1* | 7/2018 | Dominguez | B66B 1/44 |
| 2018/0215576 | A1* | 8/2018 | Wei | F16D 5/00 |
| 2018/0362291 | A1* | 12/2018 | Studer | B66B 5/0031 |
| 2019/0062112 | A1* | 2/2019 | Gorzalczynski | B66B 5/18 |

* cited by examiner

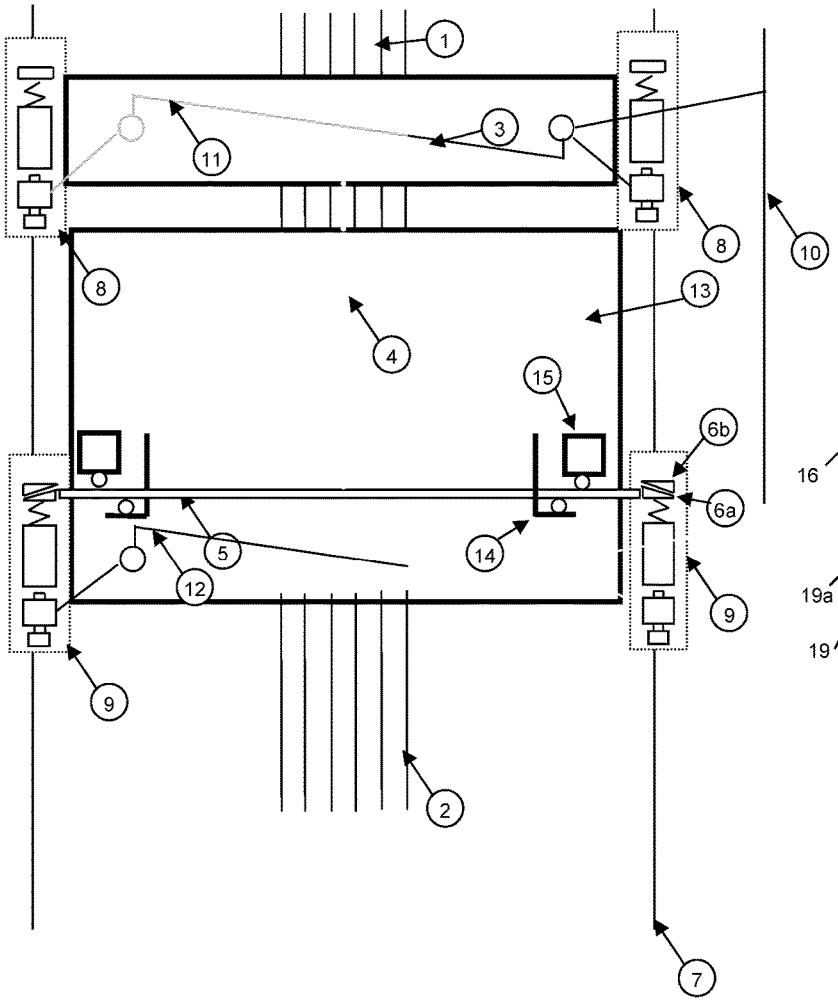
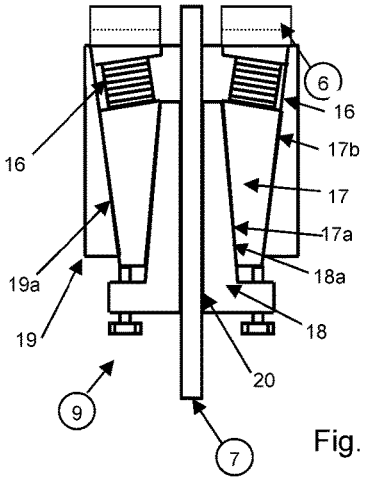
Fig. 3
Fig. 2

CONSTANT DECELERATION PROGRESSIVE SAFETY GEAR SYSTEM

FIELD OF THE INVENTION

The present invention relates to a constant deceleration progressive safety gear system for an elevator.

RELATED BACKGROUND ART

FIG. 1 shows a general configuration of an elevator which comprises an elevator car 100, a counterweight 101, a travelling cable 102, compensation ropes 103 and a compensation tension weight 104. Such an elevator is equipped with safety gears (not shown in FIG. 1) to prevent the elevator car 100 from falling down in case of suspension loss. In high travel and when rated speed exceeds 1.0 m/s, progressive safety gears are used to control the rate of deceleration of the elevator car 100. Too high deceleration would be harmful to passengers inside the car.

Elevator codes stipulate that the safety gears are entirely mechanical. The safety gears produce a constant braking force and they are adjusted according to the maximum weight of the elevator car 100 plus a portion of the masses of the compensation ropes 103, travelling cable 102 and compensation tension weight 104.

In the state shown in FIG. 1, the elevator car 100 is at a high position within the shaft and a large portion of the travelling cable 102 and of the compensation rope 103 is supported by the elevator car 100. In contrast, when the elevator car 100 is at a low position within the shaft, a smaller portion of the travelling cable 102 and of the compensation rope 103 is supported by the elevator car 100. Hence, the total mass of the elevator car 100, the travelling cable 102 and the compensation rope 103, which is to be decelerated by the safety gears of the elevator car, is larger at a high position of the elevator car 100 than at a low position of the elevator car 100.

Since the safety gears always produce constant braking force, but the load created by compensation ropes 103 and travelling cables 102 changes along the travel of the elevator car 100 as described above, the deceleration achieved by the safety gears is not constant. In other words, upon the elevator car safety gear gripping, the deceleration of the elevator car 100 is lower when the elevator car 100 is at the top of the shaft than when the elevator car 100 is at the bottom of the shaft although the mass of the elevator car 100 (or the mass of the counterweight 101) itself does not change.

In high-rise buildings (up to about 300 meters) where the masses of compensation rope 103 are significant in proportion to the mass of the elevator car 100 (or of the counterweight 101), this means that the entire deceleration range permitted by elevator codes (deceleration of 0.2 g to 1.0 g) is used.

In buildings above 300 meters, the elevator code can no longer be met, but rather the safety gears need to be dimensioned so that they produce at least 0.2 g deceleration at the top of the shaft resulting in that the deceleration of the elevator car 100 at the bottom of the shaft exceeds 1.0 g.

The setting of 0.2 g deceleration at the top of the shaft produces some risk if friction conditions are worse than when the safety gear adjustment was made. If the deceleration of 0.2 g is not met, the elevator will not stop until it reaches the bottom of the shaft.

Exceeding the deceleration of 1.0 g produces a risk of injuries to the passengers inside the car. However, increasing the braking force is particularly problematic in case of safety gear activation on counterweight side, while suspension ropes are intact, which could be caused e.g. by overspeed or may occur intendedly. In such cases, a high counterweight deceleration will cause equally high deceleration of the elevator car moving in the upward direction. Strong deceleration of the elevator car while travelling in upward direction will cause the passenger to fly upwards potentially against the elevator car ceiling and then falling back on the floor with high relative velocity.

In view of the above, it is the object of the present invention to provide an improved elevator in which the allowable deceleration range can be achieved in high-rise buildings.

According to the present invention, the above object is solved by a safety gear system having the features of claim 1.

The present invention provides a safety gear system for an elevator having a main static mass, an auxiliary static mass and a dynamically changing mass. The dynamically changing mass is changing in accordance with the travel of the main static mass. The safety gear system comprises at least a first safety gear which is configured to brake the auxiliary static mass by a constant braking force, and at least a second safety gear which is configured to brake the main static mass and the dynamically changing mass by an adjustable brake force which is adjustable in accordance with the change of the dynamically changing mass.

In this safety gear system, a static mass of the elevator may be the elevator car or the counterweight. In case of the static mass being the counterweight, the mass of the counterweight may be divided into the main static mass and the auxiliary static mass without the need of adding additional mass to the counterweight. In case of the static mass being provided by the elevator car, it might be necessary to add an additional mass for providing the auxiliary static mass with the elevator car itself corresponding to the main static mass. The term static mass implies that the mass of the static mass does not change in accordance with the travel of the main static mass, i.e. the counterweight or the elevator car.

Further, the dynamically changing mass changes in accordance with the travel of the static mass. For example, the dynamically changing mass may be the mass of a compensation rope or of a transport cable the length of which, and thus the mass of which, changes in accordance with the travel of the elevator car or the travel of counterweight.

Since the second safety gear is configured to brake the main static mass and the dynamically changing mass by an adjustable brake force which is adjustable in accordance with the change of the dynamically changing mass, these two masses can be decelerated with a larger brake force when the dynamically changing mass is larger compared to when the dynamically changing mass is small. Also, these two masses can be decelerated with a smaller brake force when the dynamically changing mass is smaller compared to when the dynamically changing mass is large.

Since the brake force provided by the second safety gear can be decreased when the dynamically changing mass is small, the deceleration of the elevator car can be kept below 1 g in case of suspension loss and thus in case of free fall, even at very high travels. This reduces loads e.g. to guide rails and thus reduces the buckling risk of the guide rails.

Since the brake force provided by the safety gears can be increased when the dynamically changing mass is large, the target deceleration of the elevator car can be kept considerably above 0.2 g in case of free fall even at very high travels. This reduces risk of "fall through" in case friction is less than expected and target deceleration is not reached.

In case of a safety gear stop due to overspeed of the upwardly travelling elevator car, the deceleration of the upwardly travelling elevator car can be kept below 1 g and thus the risk of passengers being flung against the ceiling and subsequently falling down can be prevented.

In case the system is applied at the elevator car side, it allows to decrease the deceleration of the downward moving elevator car close to the bottom of the shaft, thus reducing the risk of injuring passengers due excessive deceleration.

Preferably, the first safety gear is mounted to the auxiliary static mass and the second safety gear is mounted to the main static mass, wherein the auxiliary static mass is movably connected with the main static mass, and the adjustable brake force is adjusted in accordance with the relative movement between the auxiliary static mass and the main static mass which is caused by the change of the dynamically changing mass.

The auxiliary static mass and the main static mass are movable relative to each other. The extent of the relative movement depends on the difference in deceleration of the auxiliary static mass and the deceleration of the sum of the main static mass and the dynamically changing mass. When the dynamically changing mass is small, the deceleration of the sum of the main static mass and the dynamically changing mass is larger than when the dynamically changing mass is large. Depending on this difference in the dynamically changing mass, the auxiliary static mass and the main static mass move relative to each other and based on this relative movement, the adjustable brake force of the second safety gear is adjusted. This allows to decrease the deceleration when the dynamically changing mass is small and to increase the deceleration when the dynamically changing mass is large.

Preferably, the second safety gear comprises a movable adjustment wedge which is configured to control the braking force of the second safety gear, and the relative movement between the auxiliary static mass and the main static mass is transferred as a linear movement to the movable adjustment wedge. This allows providing a mechanical structure of the second safety gear which incorporates the function of adjusting the adjustable brake force of the second safety gear in accordance with the relative movement of the auxiliary mass and the static mass.

Preferably, the main static mass comprises a bending bar which is configured to apply the linear movement to the movable adjustment wedge in accordance with the bending of the bending bar, and the bending bar is connected to the auxiliary static mass by a connection means which is configured to apply a bending moment to the bending bar in accordance with the relative movement between the auxiliary static mass and main static mass.

Alternatively, the main static mass may comprise a spring and an adjustment bar connected to the spring, wherein the adjustment bar is configured to apply the linear movement to the movable adjustment wedges in accordance with a deformation of the spring. The spring may be connected to the auxiliary static mass by a connection means which is configured to apply a spring force to the spring in accordance with relative movement between the auxiliary static mass and the main static mass. Here, the spring may be a compression spring which is provided below the adjustment bar. In this case, the deformation of the spring is a compression of the spring and the spring force is a compression force. Alternatively, the spring may be a tension spring which is provided above the adjustment bar. In this case, the deformation of the spring is an extenuation of the spring and the spring force is a tension force.

Furthermore, the main static mass may comprise two second safety gears, each having a movable adjusting wedge. In this case, an adjustment bar can be provided for each of the safety gears and the adjustment bars can be connected to each other by a hinge. In this case, a single connection means can transmit the relative movement between the auxiliary static mass and the main static mass to the adjustment bars at or close to the hinge. Further, a single compression and/or tension spring may be provided at or close to the hinge.

Preferably, the dynamically changing mass is connected to a lower portion of the main static mass, and a suspension rope is connected to the upper portion of the main static mass. Alternatively, both the dynamically changing mass and the suspension rope can be connected to one single point of the main static mass.

Preferably, the adjustable brake force provided by the second safety gear is adjustable with respect to a reference brake force designed for applying a reference target deceleration to the main static mass and the dynamically changing mass, wherein the reference target deceleration is determined in a state in which the main static mass is at a mid-shaft position of the elevator car. This allows to set suitable deceleration values over the entire travel range of the elevator so that the deceleration is above 0.2 g also at the highest travel position of the main static mass and below 1.0 g also at the lowest travel position of the main static mass.

Preferably, the constant brake force provided by the first safety gear is designed to apply a constant target deceleration which is equal to the reference target deceleration of the second safety gear.

Preferably, the main static mass is a counterweight of the elevator, and the dynamically changing mass is a compensation rope connected to the counterweight.

Alternatively, the main static mass is an elevator car of the elevator, and the dynamically changing mass is a compensation rope and/or a traveling cable connected to the elevator car.

Preferably, the reference target deceleration is 0.6 g-force.

DESCRIPTION OF THE EMBODIMENTS

These and other objects, features, details and advantages will become more fully apparent from the following detailed description of embodiments of the present invention which is to be taken in conjunction with the appended drawings, in which:

FIG. 2 shows a safety gear system according to an embodiment of the invention.

FIG. 3 shows a safety gear acting as second safety gear in the sense of the present invention.

According to the embodiment shown in FIGS. 2 and 3, the principle of the invention is described on the counterweight side.

Figure 1:
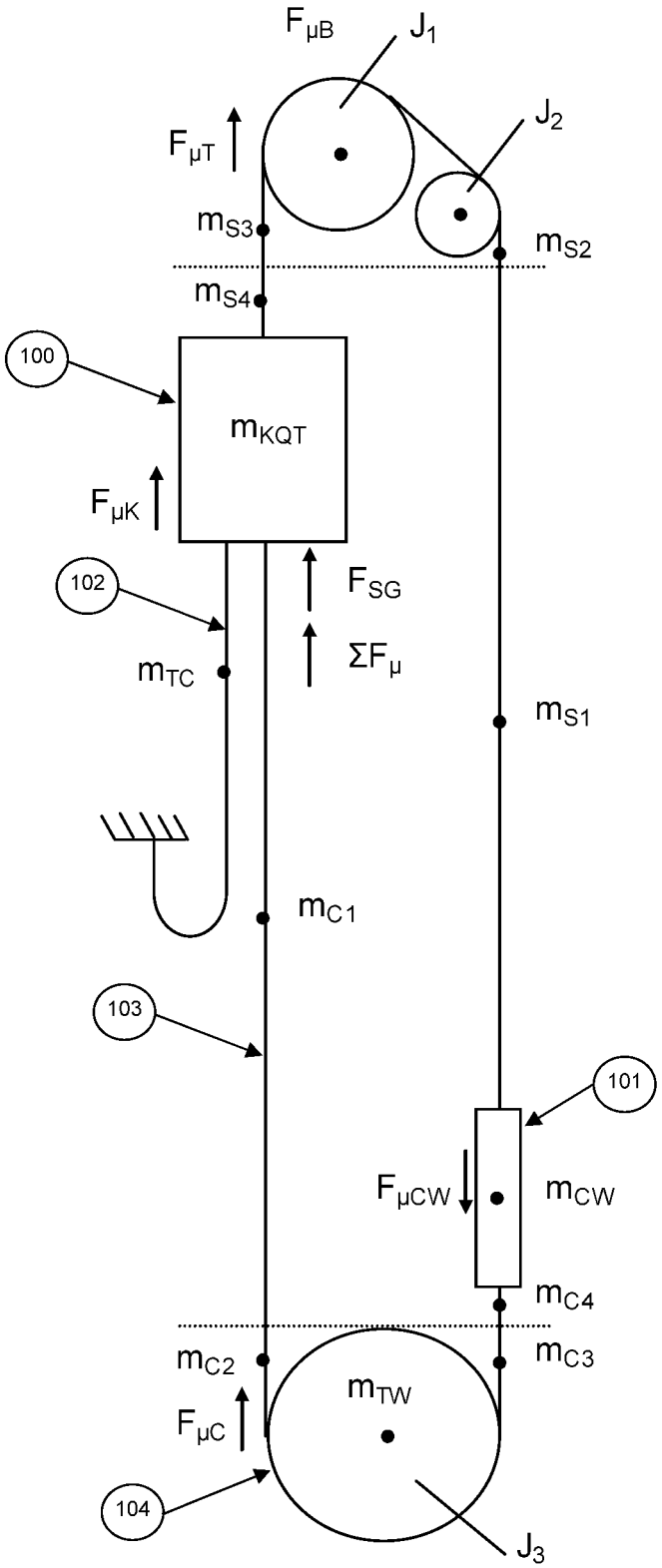
FIG. 1 shows a general configuration of an elevator system.

Making reference to FIG. 1, an elevator system comprises a counterweight 101 to which an compensation rope 102 is connected at the bottom thereof.

According to the present embodiment, the counterweight is divided into an auxiliary static mass 3 and a main static mass 13, as shown in FIG. 2. The main static mass 13 is connected to suspension ropes 1 on the upper portion thereof so as to be suspended from the hoisting machinery (not shown). A pair of first safety gears 8 is connected to the auxiliary static mass 3 and is configured to provide a constant brake force on a guide rail 7 upon activation of a synchronization mechanism 11. The synchronization mechanism 11 is activated by an overspeed governor rope 10 in a well-known manner.

A pair of second safety gears 9 is connected to the main static mass 13 and is configured to provide an adjustable brake force on the guide rail 7 upon activation of a synchronization mechanism 12. The synchronization mechanism 12 is activated by an overspeed governor rope 10 in a well-known manner.

The two pairs of safety gears 8, 9 are functionally interconnected such that the deceleration produced by the first pair of safety gears 8 is used to adjust a brake force provided by the pair of second safety gears 9.

Now, a case is considered according to which the counterweight having the main static mass 13 and the auxiliary static mass 3 moves downward and is braked by the pairs of safety gears 8, 9. As the pair of safety gears 8 produces a constant braking force and the weight of the auxiliary static mass 3 to be braked remains constant, the produced deceleration remains constant (a=F/m). Now, if the auxiliary static mass 3, which is decelerated by the pair of first safety gears 8 starts to move away from the main static mass 13 of the counterweight, the braking force of the pair of adjustable safety gears 9 needs to be increased. Further, when the auxiliary static mass 3, which is decelerated by the pair of first safety gears 8 starts to move closer to the main static mass 13 of the counterweight, the braking force of the pair of adjustable safety gears 9 needs to be decreased.

In the schematic presentation of FIG. 2, the overspeed governor rope 10 acts on the synchronization mechanism 11 of the auxiliary static mass 3 and thus on the pair of first safety gears 8. This auxiliary static mass 3 is supported by the main static mass 13 of the counterweight and can be considered as part of the counterweight mass. The suspension ropes 1 are attached to the main static mass 13 of the counterweight. As the overspeed governor rope 10 engages the pair of first safety gears 8, the auxiliary static mass 3 starts to decelerate independently of the main static mass 13 and the mass of the compensation ropes 2.

The pair of adjustable safety gears 9 is engaged either directly by the overspeed governor rope 10 like the pair of first safety gears 8 or by separate means due to the increasing distance between the auxiliary static mass 3 and the main static mass 13. Regardless of the engagement method, the deceleration of the main static mass 13 caused by the second safety gears 9 is affected by the mass of the compensation ropes 2.

It is now assumed that the auxiliary static mass 3 and the main static mass 13 are not connected to each other. Further, it is assumed that the pair of first safety gears 8, which provide a constant braking force, is factory adjusted to produce 0.6 g deceleration for the auxiliary static mass 3. Further, it is assumed that the pair of second safety gears 9, which provides an adjustable braking force, is factory adjusted to produce 0.6 g deceleration for the main static mass 13 and for half of the mass of compensation rope 2. It is noted that, when the counterweight is at a mid-shaft position, i.e. the position of the counterweight at the longitudinal midpoint of the elevator shaft (not shown in the figures), half of the compensation rope 2 is acting as a mass on the main static mass 13.

Under these assumptions, the auxiliary static mass 3 and the main static mass 13 would start to move towards each other upon safety gear activation below the mid-shaft position. The reason is that below the mid-shaft position, the mass of the compensation rope 2 becomes smaller than that which was used, combined with the main static mass 13, for dimensioning the pair of second safety gears 9 to achieve the 0.6 g deceleration of the main static mass 13. At the same time, the braking force of the second safety gears 9 acting on the main static mass 13 remains the same. Thus, the main static mass 13 is decelerated to a larger extent than at the mid-shaft position while the deceleration of the auxiliary mass 3 remains the same.

Further, the auxiliary static mass 3 and the main static mass 13 would start to divert away from each other above the mid-shaft position. The reason is that above the mid-shaft position, the mass of the compensation rope 2 becomes larger than that which was used, combined with the main static mass 13, for dimensioning the pair of second safety gears 9 to achieve the 0.6 g deceleration of the main static mass 13. At the same time, the braking force of the second safety gears 9 acting on the main static mass 13 remains the same. Thus, the main static mass 13 is decelerated to a smaller extent than at the mid-shaft position while the deceleration of the auxiliary mass 3 remains the same.

Figure 4:
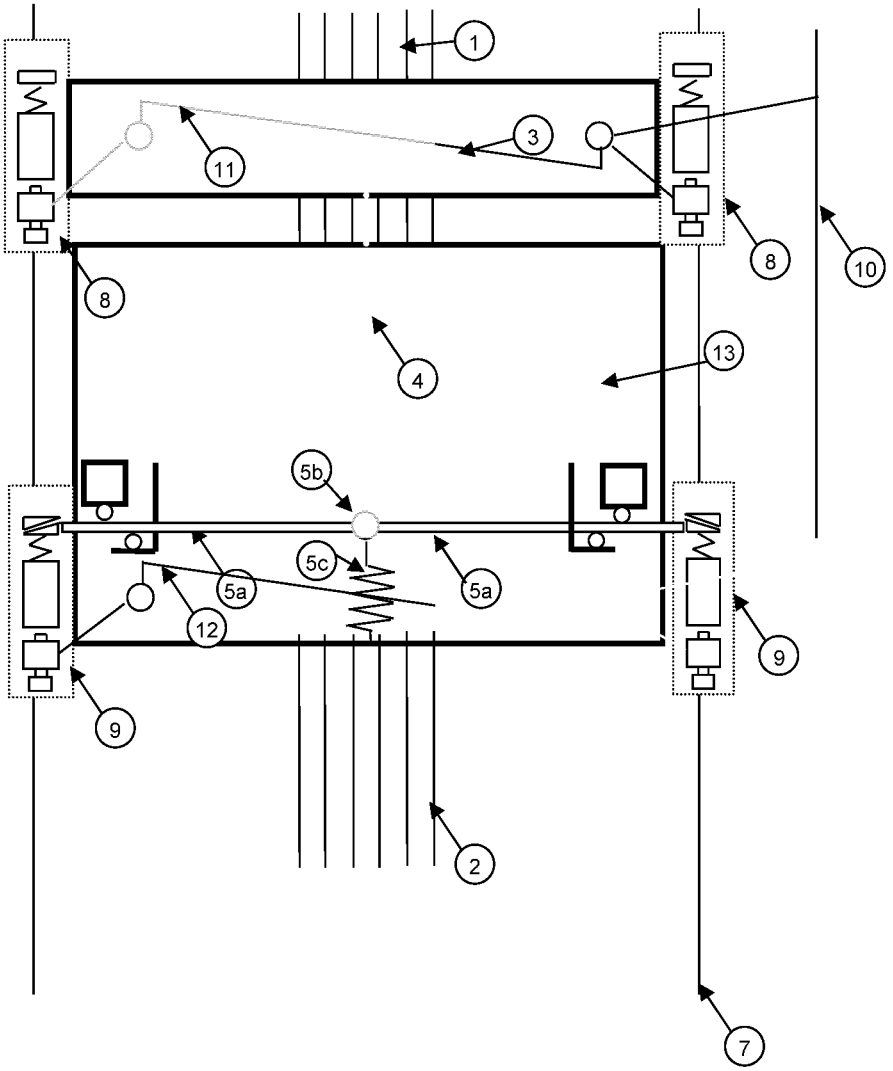
FIG. 4 shows a safety gear system according to another embodiment.

According to the present invention, the auxiliary static mass 3 is supported by the main static mass 13 e.g. by means of a connection rod 4 and a bending bar 5, as depicted in FIGS. 2 and 4, by means of which the relative movement between the auxiliary static mass 3 and the main static mass 13 is utilized to adjust the braking force provided by the pair of second safety gears 9.

As can be seen in FIG. 2, the bending bar 5 is supported by lower bearings 14 and by upper bearings 15. In a stationary situation, the bending bar 5 is bent to a certain extent due to the weight of the auxiliary static mass 3. In FIG. 2, the bending bar 5 is shown schematically and the bending thereof is not depicted. When the auxiliary static mass 3 and the main static mass 13 move towards each other, the connection rod 4 acts on the bending bar 5 in a manner to increase the bending of the bending bar 5. When the auxiliary static mass 3 and the main static mass 13 divert from each other, the connection rod 4 acts on the bending bar 5 in a manner to decrease the bending of the bending bar 5.

The ends of the bending bar 5 act on respective movable adjusting wedges **6*a* within the safety gears 9. The movable adjusting wedges 6*a* interact with fixed adjusting wedges 6*b* of the second safety gears 9. That is, the movable adjusting wedges 6*a* have an inclined surface on the top side, and the fixed adjusting wedges 6*b* have an inclined counter surface on the bottom side. When the movable adjusting wedge 6*a* is pushed by the end of the bending bar 5, the braking force of the second safety gear 9 is increased. When the adjustable wedge 6*b* is pulled by the end of the bending 5, the braking force of the second safety gear 9** is decreased.

As explained above, the bending bar is in a stationary situation bent by the weight of the auxiliary static mass 3. When the static masses 3 and 13 approach each other, the bending amount of the bending bar 5 increases with the result that the ends of the bending bar 5 pull the movable adjusting wedges **6*a*, thus decreasing the braking force of the second safety gears 9. In contrast, when the static masses 3 and 13 move away from each other, the bending amount of the bending bar 5 decreases with the result that the ends of the bending bar 5 push the movable adjusting wedges 6*a*, thus increasing the braking force of the second safety gears 9**.

Now, making reference to FIG. 3, the adjustment of the braking force of the second safety gears 9 is described.

As can be seen in FIG. 3, the second safety gear 9 comprises a wedge chamber 19 for accommodating brake wedges 18 and counter wedges 17. Each brake wedge 18 comprises a guide groove (not shown) for guiding the brake wedge 18 with respect to guide pins (not shown) mounted to the wedge chamber 19. The upper ends of the brake wedges 18 are connected to associated actuation levers (not shown) which are actuated by the synchronization mechanism 12. In the front view of FIG. 3, the brake wedges 18 have a substantial triangular shape with an inner lateral side and an outer lateral side 18*a*. This inner lateral side is oriented substantially vertically and comprises a friction surface 20 acting on the guide rail 7 when the second safety gear 9 is activated. The outer lateral side of the brake wedge 18 is inclined with respect to the vertical direction. The outer lateral side 18*a* is inclined such that the upper end of the brake wedge 18 has a smaller width in the lateral direction than the lower end thereof.

The counter wedges 17 have a substantially triangular shape when seen in the front view of FIG. 3. An inner lateral side 17*a* of the counter wedges 17 is substantially parallel to the outer lateral side 18*a* of the adjacent brake wedge 18. As a result, the brake wedge 18 and the counter wedge 17 can slide with respect to each other.

The outer lateral sides 17*b* of the counter wedges 17 are inclined with respect to the vertical direction such that the lower end of the counter wedge 17 has a smaller width in the lateral direction than the upper end thereof. The counter wedge 17 can slide along a counter surface 19*a* of the wedge chamber 19 at the outer lateral side 17*b*.

Compression springs 16 are connected to the upper ends of the counter wedges 17. The compression springs 16 are oriented such that their spring forces act in parallel to the outer lateral side 17*b* of the counter wedge 17 and the counter surface 19*a* of the wedge chamber 19.

When the second safety gear 9 is activated by means of the actuation levers, the brake wedges 18 are pulled upwardly to a larger extent than the counter wedges 17 are pressed against the compression springs 16. Due to the inclined lateral sides of the wedges 17, 18, the brake wedges 18 are pressed inwardly such that the friction surfaces 20 apply a braking force to the elevator guide rail 7 due to which the main static mass is stopped.

Further, as is shown in FIG. 3, adjustment wedges 6 are provided above the springs 16 and form a support for the force applied by the counter wedges 17 to the springs 16. When the counterweight is at the mid-shaft position, it is assumed that the bending bar 5 is bent in such a manner that the movable adjustment wedge 6*a* is neither pushed nor pulled and it is a neutral position. In this neutral position, the second safety gear 9 provides the factory adjusted braking force for a deceleration of 0.6 g.

When the counterweight is above the mid-shaft position and the mass of the compensation ropes 2 becomes larger, the distance between the auxiliary static mass 3 and the main static mass 13 becomes larger with the result that the bending bar 5 is bent to a smaller extent. As a consequence, the movable adjusting wedges 6*a* are pushed by the ends of the bending bar 5 and, as a further consequence, the counter wedges 17 are pushed downwards. As the counter wedges 17 are pushed downwards when the brake wedges 18 are pulled upwards for braking, the braking wedges 18 are pressed more against the guide rail 7 such that the braking force is increased. As a result, the main static mass 13 can be braked to a larger extent such that the deceleration does not strongly decrease due to the increase of the mass of the compensation ropes 2.

By contrast, when the counterweight is below the mid-shaft position and the mass of the compensation ropes 2 becomes smaller, the distance between the auxiliary static mass 3 and the main static mass 13 becomes smaller with the result that the bending bar 5 is bent to a larger extent. As a consequence, the movable adjusting wedges 6*a* are pulled by the ends of the bending bar 5 and, as a further consequence, the counter wedges 17 can move upwards. As the counter wedges 17 are moved upwards, the braking wedges 18 are pressed less against the guide rail 7 such that the braking force is decreased. As a result, the main static mass 13 will be braked to a smaller extent such that the deceleration does not strongly increase due to the decrease of the mass of the compensation ropes 2.

In a preferable embodiment, the weight of the auxiliary static mass 3 is specified as 1000 kg, because experience shows that achieving constant braking force is easier when the weight of the auxiliary static mass 3 is sufficiently high. However, the weight can be substantially less, if the safety gear adjustment can be ensured.

There are a number of methods of how to transfer the relative movement of the two masses 3, 13 to linear motion of the movable adjustment wedges instead of the bending bar given in the example.

For example, in a further embodiment shown in FIG. 4, the bending bar 5 can be replaced by two bars 5*a* which are connected by a hinge 5*b* to which or close to which also the connection rod 4 is connected. Furthermore, a compression spring 5*c* is connected to the hinge 5*b*. In a further modification, the spring does not need to be a compression spring provided below the hinge 5*b* but can also be a tension spring provided above the hinge 5*c*. When the static masses 3 and 13 approach each other, the connection rod 4 acts against the spring 5*c* in such a manner that the hinge 5*b* is moved downward with respect to the main static mass 13. As a result, the wedges 6*a* are pulled. By contrast, when the static masses 3 and 13 are moved away from each other, the connection rod 4 acts on the spring 5*c* in such a manner that the hinge 5*b* is moved upward with respect to the main static mass 13. As a result, the wedges 6*b* are pushed.

A similar system can also be applied on car side, although with some disadvantages. On counterweight side, the counterweight mass can be divided into the auxiliary static mass and the main static mass. Thus, no actual additional mass is needed. On car side, the simplest method is to have the auxiliary static mass as an additional mass, which affects the needed hoisting capacity. It is also conceivable to utilize the car or parts of the car sling as the auxiliary static mass.

The invention claimed is:

1. A safety gear system for an elevator having a main static mass, an auxiliary static mass and a dynamically changing mass, the dynamically changing mass changing in accordance with the travel of the main static mass, wherein the safety gear system comprises:

at least one first safety gear configured to brake the auxiliary static mass by a constant braking force; and at least one second safety gear configured to brake the main static mass and the dynamically changing mass by an adjustable brake force, the adjustable brake force being adjustable in accordance with the change of the dynamically changing mass, wherein:

the first safety gear is mounted to the auxiliary static mass and the second safety gear is mounted to the main static mass, the auxiliary static mass is movably connected with the main static mass by a connecting rod, and the relative movement between the auxiliary static mass and the main static mass caused by the change of the dynamically changing mass causes the connecting rod to adjust the adjustable brake force.

2. The safety gear system according to claim 1, wherein:

the second safety gear comprises a movable adjustment wedge configured to control the braking force of the second safety gear; and the relative movement between the auxiliary static mass and the main static mass is transferred from the connecting rod as a linear movement through at least one bar to the movable adjustment wedge.

3. The safety gear system according to claim 2, wherein:

the dynamically changing mass is connected to a lower portion of the main static mass; and a suspension rope is connected to the upper portion of the main static mass.

4. The safety gear system according to claim 2, wherein:

the adjustable brake force provided by the second safety gear is adjustable with respect to a reference brake force designed for applying a reference target deceleration to the main static mass and the dynamically changing mass; and the reference target deceleration is determined in a state in which the main static mass is at a mid-shaft position.

5. The safety gear system according to claim 2, wherein:

the main static mass comprises the at least one bar, the at least one bar being a bending bar configured to apply the linear movement to the movable adjustment wedge in accordance with the bending of the bending bar; and the bending bar is connected to the auxiliary static mass by the connecting rod, the connecting rod being configured to apply a bending force to the bending bar in accordance with the relative movement between the auxiliary static mass and main static mass.

6. The safety gear system according to claim 5, wherein:

the dynamically changing mass is connected to a lower portion of the main static mass; and a suspension rope is connected to the upper portion of the main static mass.

7. The safety gear system according to claim 5, wherein:

the adjustable brake force provided by the second safety gear is adjustable with respect to a reference brake force designed for applying a reference target deceleration to the main static mass and the dynamically changing mass; and the reference target deceleration is determined in a state in which the main static mass is at a mid-shaft position.

8. The safety gear system according to claim 2, wherein:

the main static mass comprises a spring and the at least one bar, the at least one bar being an adjustment bar connected to the spring, the adjustment bar is configured to apply the linear movement to the movable adjustment wedge in accordance with a deformation of the spring; and the spring is connected to the auxiliary static mass by the connecting rod, the connecting rod being configured to apply a spring force to the spring in accordance with relative movement between the auxiliary static mass and the main static mass.

9. The safety gear system according to claim 8, wherein:

the dynamically changing mass is connected to a lower portion of the main static mass; and a suspension rope is connected to the upper portion of the main static mass.

10. The safety gear system according to claim 8, wherein:

the adjustable brake force provided by the second safety gear is adjustable with respect to a reference brake force designed for applying a reference target deceleration to the main static mass and the dynamically changing mass; and the reference target deceleration is determined in a state in which the main static mass is at a mid-shaft position.

11. The safety gear system according to claim 1, wherein:

the dynamically changing mass is connected to a lower portion of the main static mass; and a suspension rope is connected to the upper portion of the main static mass.

12. The safety gear system according to claim 11 wherein:

the adjustable brake force provided by the second safety gear is adjustable with respect to a reference brake force designed for applying a reference target deceleration to the main static mass and the dynamically changing mass; and the reference target deceleration is determined in a state in which the main static mass is at a mid-shaft position.

13. The safety gear system according to claim 1, wherein:

the adjustable brake force provided by the second safety gear is adjustable with respect to a reference brake force designed for applying a reference target deceleration to the main static mass and the dynamically changing mass; and the reference target deceleration is determined in a state in which the main static mass is at a mid-shaft position.

14. The safety gear system according to claim 13, wherein the constant brake force provided by the first safety gear is designed to apply a constant target deceleration which is equal to the reference target deceleration of the second safety gear.

15. The safety gear system according to claim 13, wherein the reference target deceleration is 0.6 g-force.

16. The safety gear system according to claim 1, wherein:

the elevator has a counterweight comprising the main static mass and the auxiliary static mass; and the dynamically changing mass is a compensation rope connected to the counterweight.

17. The safety gear system according to claim 1, wherein:

the main static mass is an elevator car of the elevator; and the dynamically changing mass is a compensation rope and/or a traveling cable connected to the elevator car.

18. A safety gear system for an elevator having a main static mass, an auxiliary static mass and a dynamically changing mass, the dynamically changing mass changing in accordance with the travel of the main static mass, wherein the safety gear system comprises:

at least one first safety gear configured to brake the auxiliary static mass by a constant braking force; and at least one second safety gear configured to brake the main static mass and the dynamically changing mass by an adjustable brake force, the adjustable brake force being adjustable in accordance with the change of the dynamically changing mass, wherein:

the first safety gear is mounted to the auxiliary static mass and the second safety gear is mounted to the main static mass, the auxiliary static mass is movably connected with the main static mass by a connecting rod, the second safety gear comprises a movable adjustment wedge configured to control the braking force of the second safety gear, the relative movement between the auxiliary static mass and the main static mass is transferred as a linear movement to the movable adjustment wedge, the main static mass comprises a bending bar connected to the connecting rod and configured to apply the linear movement to the movable adjustment wedge in accordance with the bending of the bending bar, and the bending bar is connected to the auxiliary static mass by the connecting rod that is configured to apply a bending force to the bending bar in accordance with the relative movement between the auxiliary static mass and main static mass to adjust the adjustable brake force, the relative movement being caused by a change of the dynamically changing mass.

* * * * *